US008182268B2

(12) United States Patent
Rekort

(10) Patent No.: US 8,182,268 B2
(45) Date of Patent: May 22, 2012

(54) GAME APPARATUS AND METHOD FOR TEACHING CORE REPLACEMENT BEHAVIORS

(76) Inventor: Cynthia P. Rekort, Pinellas Park, FL (US)

( * ) Notice: Subject to any disclaimer, the term of this patent is extended or adjusted under 35 U.S.C. 154(b) by 674 days.

(21) Appl. No.: 12/283,737

(22) Filed: Sep. 15, 2008

(65) Prior Publication Data

US 2010/0068681 A1 Mar. 18, 2010

(51) Int. Cl.
*G09B 19/00* (2006.01)

(52) U.S. Cl. ..... 434/236

(58) Field of Classification Search ..... 434/219, 434/236, 237, 238, 247, 433; 273/292, 296, 273/302

See application file for complete search history.

(56) References Cited

U.S. PATENT DOCUMENTS

| | | | | | |
|---|---|---|---|---|---|
| 2,414,614 | A * | 1/1947 | Shurick, Sr. | 434/238 |
| 2,512,485 | A * | 6/1950 | Cougias | 434/238 |
| 2,883,765 | A * | 4/1959 | Blaine | 434/238 |
| 2,965,978 | A * | 12/1960 | Olson | 434/238 |
| 3,035,355 | A * | 5/1962 | Holmes | 434/238 |
| 3,290,796 | A * | 12/1966 | Gurda | 434/238 |
| 4,776,799 | A * | 10/1988 | Walsh | 434/238 |
| 5,190,459 | A * | 3/1993 | Determan | 434/238 |
| 5,372,509 | A * | 12/1994 | Brocato et al. | 434/238 |
| 5,577,915 | A * | 11/1996 | Feldman | 434/238 |
| 5,639,242 | A * | 6/1997 | Wilson | 434/238 |
| 5,725,381 | A * | 3/1998 | Kollath et al. | 434/238 |
| 5,954,510 | A | 9/1999 | Merrill et al. | |
| 5,954,512 | A | 9/1999 | Fruge | |
| 6,203,327 | B1 * | 3/2001 | Ottrando | 434/262 |
| 6,345,821 | B1 * | 2/2002 | Labrot | 273/236 |
| D458,303 | S * | 6/2002 | Daugherty | D19/20 |
| 6,572,380 | B1 | 6/2003 | Buckley et al. | |
| 6,722,886 | B2 | 4/2004 | Blumberg | |
| 7,491,063 | B1 * | 2/2009 | Santarsiero | 434/236 |
| 7,540,741 | B2 * | 6/2009 | Kemp et al. | 434/247 |
| 7,896,652 | B1 * | 3/2011 | Van Balveren et al. | 434/236 |
| 2001/0034013 | A1 | 10/2001 | Bennett | |
| 2005/0042586 | A1 * | 2/2005 | Carpenter et al. | 434/238 |
| 2007/0020596 | A1 | 1/2007 | Thurman | |
| 2007/0241499 | A1 | 10/2007 | Novakovich et al. | |

* cited by examiner

*Primary Examiner* — Kurt Fernstrom
(74) *Attorney, Agent, or Firm* — Sidney W. Kilgore, Esq.

(57) ABSTRACT

The present invention comprises a game apparatus and method for teaching and providing practice in core replacement behaviors, such as Asking the Question (i.e., Manding), Accepting "No", Waiting and Sharing, to individuals with behavior challenges, including individuals with special needs. Grounded in principles of Applied Behavioral Analysis, the invention allow a trainer, through discrete trial training in an entertaining game format, to manipulate motivating operations in order to teach in a positive fashion these core replacement behaviors to a player. The method also incorporates the use of other procedural components, such as interspersing easy and difficult tasks and demand fading. Data as to a player's performance and progress in carrying out these core replacement behaviors may be collected and recorded both by trainers with respect to game sessions and by direct care providers in the natural environment.

8 Claims, 10 Drawing Sheets

The Lucky 7 Game
Data Sheet

| | | | | |
|---|---|---|---|---|
| Session # ____ Date: _____ | Task 1 - | Ask ? + P – | Answer: Y N W S<br>Response: + P – | Comments: |
| | Task 2 - | Ask ? + P – | Answer: Y N W S<br>Response: + P – | Comments: |
| | Task 3 - | Ask ? + P – | Answer: Y N W S<br>Response: + P – | Comments: |
| | Task 4 - | Ask ? + P – | Answer: Y N W S<br>Response: + P – | Comments: |
| | Task 5 - | Ask ? + P – | Answer: Y N W S<br>Response: + P – | Comments: |
| | Task 6 - | Ask ? + P – | Answer: Y N W S<br>Response: + P – | Comments: |
| | Task 7 - | Ask ? + P – | Answer: Y N W S<br>Response: + P – | Comments: |
| Session # ____ Date: _____ | Task 1 - | Ask ? + P – | Answer: Y N W S<br>Response: + P – | Comments: |
| | Task 2 - | Ask ? + P – | Answer: Y N W S<br>Response: + P – | Comments: |
| | Task 3 - | Ask ? + P – | Answer: Y N W S<br>Response: + P – | Comments: |
| | Task 4 - | Ask ? + P – | Answer: Y N W S<br>Response: + P – | Comments: |
| | Task 5 - | Ask ? + P – | Answer: Y N W S<br>Response: + P – | Comments: |
| | Task 6 - | Ask ? + P – | Answer: Y N W S<br>Response: + P – | Comments: |
| | Task 7 - | Ask ? + P – | Answer: Y N W S<br>Response: + P – | Comments: |
| Session # ____ Date: _____ | Task 1 - | Ask ? + P – | Answer: Y N W S<br>Response: + P – | Comments: |
| | Task 2 - | Ask ? + P – | Answer: Y N W S<br>Response: + P – | Comments: |
| | Task 3 - | Ask ? + P – | Answer: Y N W S<br>Response: + P – | Comments: |
| | Task 4 - | Ask ? + P – | Answer: Y N W S<br>Response: + P – | Comments: |
| | Task 5 - | Ask ? + P – | Answer: Y N W S<br>Response: + P – | Comments: |
| | Task 6 - | Ask ? + P – | Answer: Y N W S<br>Response: + P – | Comments: |
| | Task 7 - | Ask ? + P – | Answer: Y N W S<br>Response: + P – | Comments: |

KEY:
+ = Correct
P = Prompted
-- = Incorrect

Y =yes
N = no

W = wait
S = share

FIG. 11

Natural Environment: Ask the Question Data Sheet

| Date: | | | | | | |
|---|---|---|---|---|---|---|
| Mark a " +" for each Correct Response:<br><br>When an opportunity arose for the learner to ask for an item, activity, or attention, s/he did so correctly | | | | | | |
| Mark a "P" if the response was prompted:<br><br>When an opportunity arose for the learner to ask for an item, activity, or attention s/he did so correctly after being prompted | | | | | | |
| Mark a "--" if the response was incorrect:<br>When an opportunity arose for the learner to ask for an item, activity, or attention s/he did so incorrectly and/or did not comply with answer | | | | | | |

FIG. 12

GAME APPARATUS AND METHOD FOR TEACHING CORE REPLACEMENT BEHAVIORS

CROSS-REFERENCES TO RELATED APPLICATIONS

Not applicable.

STATEMENT REGARDING FEDERALLY SPONSORED RESEARCH OR DEVELOPMENT

Not applicable.

MICROFICHE APPENDIX

Not applicable.

BACKGROUND OF THE INVENTION

1. Field of the Invention

This invention relates to the field of psychology education and demonstration, particularly with respect to forms of behavioral intervention for teaching and providing practice in core replacement behaviors to individuals with behavioral challenges.

2. Description of Related Art

Applied behavior analysis provides a scientific means of improving socially significant behavior through the application of experimentally derived behavioral principles. To facilitate the assessment of changes in behavior over time, behaviors are defined in observable, measurable ways. Targeted behaviors of interest are then observed within the environment in which they occur in order to identify and evaluate the factors that engender or influence those behaviors. Interventions can then be designed to achieve positive behavioral changes.

The capacity of applied behavior analysis to create positive changes in behavior lies not only in the motivational strategies developed to achieve those changes, but in certain teaching and practice components that leverage those motivational strategies, and indeed, provide the necessary groundwork for such strategies to work. In particular, discrete trial training, in which a trainer guides an individual learner through multiple trials of training and reinforcement through errorless learning, contributes substantially to the successful implementation of applied behavior analysis by ensuring that the individual develops the ability to carry out the desired behaviors that such motivational strategies seek to achieve.

These teaching and practice components become particularly critical when an individual lacks, or is insufficiently accomplished in, the very skill sets necessary to adopt the positive behaviors that are the object of motivational strategies. In order for motivational strategies to succeed in changing the behaviors of individuals of normal development who have not yet achieved sufficient developmental maturity to have learned or mastered given skills, as well as those of special needs individuals with physical, mental, or emotional disabilities or developmental deficits who do not possess, or are not adept at, those necessary skills, the requisite skill sets must first be taught.

Various devices and methods have been developed for implementing motivational strategies for achieving positive behavioral changes in individuals and tracking individual progress towards this end. These devices and methods, however, have been designed principally for use with individuals who are assumed to have mastered the skill sets necessary to perform the positive behaviors that are the object of these motivational strategies. Such devices and methods, therefore, focus solely on getting individuals to use behavioral skills they already possess or on providing a structure in which those behavioral skills may be used. Indeed, the complexity of many of these devices and methods reflects an implicit assumption that the individuals who are to use and benefit from them are well within normal ranges for physical, mental, and emotional function. They are therefore of little or no value for use with behaviorally challenged individuals suffering from fundamental physical, mental, or emotional disabilities, deficits, or delays, or with individuals who enjoy normal development but are insufficiently mature to utilize or benefit from them.

BRIEF SUMMARY OF THE INVENTION

The present invention comprises a new and improved game apparatus and method for teaching and providing practice in core replacement behaviors to individuals with behavior challenges.

BRIEF DESCRIPTION OF THE SEVERAL VIEWS OF THE DRAWINGS

FIG. 11 illustrates one possible version of a Data Collection Sheet for use by one or more trainers in recording game session results.

FIG. 12 illustrates one possible version of a Data Collection Sheet for use by one or more direct care providers in the natural environment.

REFERENCE NUMERALS IN THE DRAWINGS

0 Game Board

Figure 1:
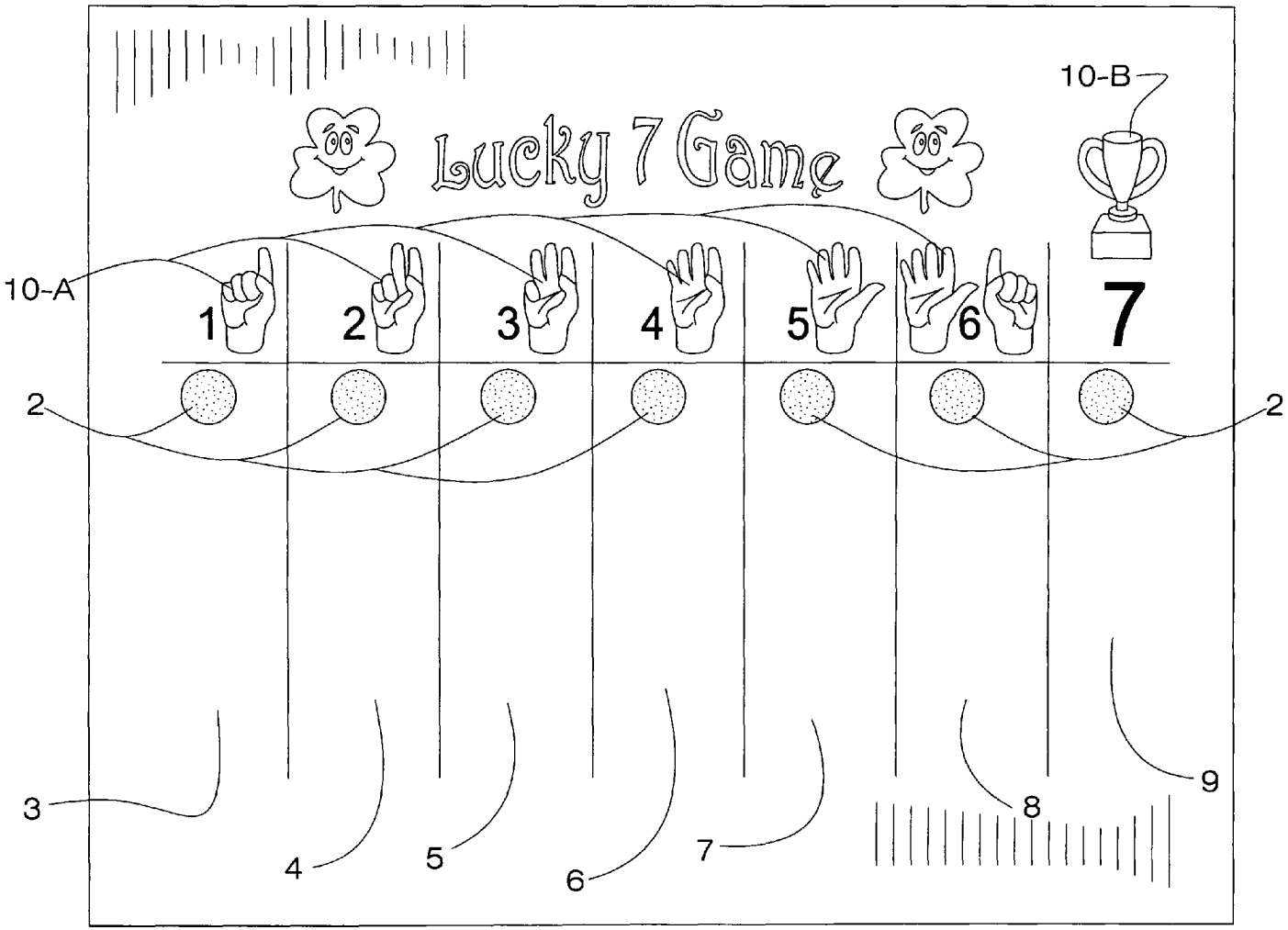
FIG. 1 presents an overhead perspective of one possible configuration of a Game Board.

1 Hard-sided Velcro® dot or other removable fastener.

2 Soft-sided Velcro® dot or other removable fastener.

3 First enumerated spot for placement of First Answer Card.

4 Second enumerated spot for placement of Second Answer Card.

5 Third enumerated spot for placement of Third Answer Card.

6 Fourth enumerated spot for placement of Fourth Answer Card.

7 Fifth enumerated spot for placement of Fifth Answer Card.

8 Sixth and penultimate enumerated spot for placement of Sixth Answer Card.

9 Seventh and last or final enumerated spot for placement of Seventh and final Answer Card.

10-A Stylized pictures of hands, each signing the sequential number of each spot from the first spot through the sixth (penultimate) spot.

10-B Stylized picture of a trophy suggesting a game win and reward upon reaching the seventh (final) spot.

11 Printed Front of Yes Answer Card.

12 Blank Rear of Yes Answer Card.

13 Printed Front of No Answer Card.

14 Blank Rear of No Answer Card.

15 Printed Front of Wait Answer Card.

16 Blank Rear of Wait Answer Card.

17 Printed Front of Share Answer Card.

18 Blank Rear of Share Answer Card.

19 Printed Front of Pre-Determined Question Card.

20 Front of Blank Question Card.

21 Game Session Data Collection Sheet.

22 Game Session Data Field.

23 Task Data Field.

24 "Ask?" Data Field.

25 "Answer" Data Field.

26 "Comments" Data Field.

27 Natural Environment Data Collection Sheet.

28 Date Data Field.

29 Success Data Field.

30 Prompt Data Field.

31 No Success-No Compliance Data Field.

DETAILED DESCRIPTION OF THE INVENTION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all (copyright or mask work) rights whatsoever.

The present invention comprises a game apparatus and method designed to enable one or more trainers—including, by way of example but not limitation, behavioral therapists—to teach and provide practice in core replacement behaviors, such as Asking the Question (i.e., Manding), Accepting "No", Waiting and Sharing, to one or more players with behavioral challenges, such as individuals with special needs arising from physical, mental, or emotional disabilities. Challenging behaviors that are a function of social positive reinforcement or social negative reinforcement, or both, are replaced with socialization behaviors that many individuals with behavioral challenges have not yet learned or with which they may not yet be fluent.

The present invention is grounded in principles and procedures of Applied Behavior Analysis. By way of example, but not limitation, individuals who have learned to gain access to reinforcers through challenging behaviors, rather than through Asking, Waiting, Sharing and sometimes Accepting "No", typically lack motivation to learn these alternative replacement behaviors. Various embodiments of the present invention allow a trainer, through discrete trial training in a game format, to manipulate motivating operations (MO) in order to positively teach these core replacement behaviors to a player.

At least one such embodiment manipulates motivating operations, in part, through the use of a promised reinforcer that a player selects at the beginning of a Game and receives at the end of a Game, receipt of that promised reinforcer being contingent on the cooperation of that player. That is, if the player practices the core behavior(s) correctly throughout a game, that player receives the promised reinforcer at the end of that game.

Through this process, core replacement behaviors such as Asking (Manding), Accepting "No", Waiting, and Sharing result in a positive outcome for a player, and thus, reinforcement and strengthening of these behaviors in the repertoire of the player occur. A player quickly discovers that the game is something that is really enjoyable to play, and more importantly, that Manding, Accepting "No", Waiting, and Sharing are behaviors the player enjoys doing.

Various possible embodiments of the invention program for positive change through other procedural components, such as: 1) interspersing easy and difficult tasks; and 2) demand fading. These procedural components involve starting a learning process with tasks that a player is challenged to accomplish that are primarily easy demands, then gradually and systematically fading in increasingly more difficult demands while continuing to intersperse easy tasks.

Interspersing easy tasks (that result in correct responding) with difficult tasks reduces the motivation of a player to escape a game session (round), a second form of MO manipulation. Interspersing easy tasks with difficult tasks, and demand fading, may be accomplished by pre-arrangement of Question Cards and Answer Cards, prior to every game session, based on the results of prior sessions, in any. If a player succeeds in completing a game session and thus receives a promised reinforcer, then that may be considered a successful game session. A trainer then considers interspersing another difficult task at the next game session, gradually increasing the frequency of difficult tasks. Conversely, if a game session is not successful, a trainer may consider interspersing fewer difficult tasks for a player than were attempted in the previous unsuccessful game session.

Each task that a player is challenged to perform in a game is defined by a combination of one Question Card and one Answer Card. Examples of easy tasks would be Question Cards that cue a player to ask for things that player typically desires coupled with matching Answer Cards that say "Yes," or Question Cards that cue a player to ask for things the player typically does not desire, coupled with Answer Cards that say "No," "Wait," or "Share." Examples of difficult tasks could include Question Cards that cue a player to ask for things the player typically desires, coupled with Answer Cards that say "No," "Wait," or "Share."

The demand fading procedure ensures that the core replacement behaviors being taught (i.e., Manding, Waiting, etc.) are efficient ways for the player to receive reinforcement, thus reducing the aversiveness of, and corresponding resistance to, demands calling for the performance of those core replacement behaviors. Each demand becomes a promise of reinforcers to follow, as opposed to a threat of no reinforcement. Through the demand fading procedure, response persistence with difficult tasks occurs as a result of a high rate of reinforcement during game sessions, generating behavioral momentum. A corresponding reduction in the value of escape from demands also occurs.

Another component found in various embodiments of the invention involves programming for transfer (generalization) of behaviors to natural situations, that is, in the natural environment. Direct care providers—those who ordinarily and regularly provide direct care to persons with physical, mental, or emotional disabilities—may participate intermittently in game sessions with a trainer and a player in order to learn key phrases (i.e., "Ask the question," "Sometimes you have to wait," "Sometimes you have to share," and "Sometimes the answer is 'No'"), and also to become paired with the promised reinforcer. Direct care providers then may use the key phrases (as cues and prompts to signal a player to perform one or more core replacement behaviors) throughout the day, when relevant situations occur in which the player could benefit from performing one of the replacement behaviors (Manding, Waiting, Sharing, Accepting "No") outside of the context of a game session. This generalization programming is understood to work because prior game sessions have correlated: 1) replacement behavior responses with reinforcement; and 2) direct care providers with reinforcement contingencies surrounding one or more core replacement behaviors.

Figure 6:
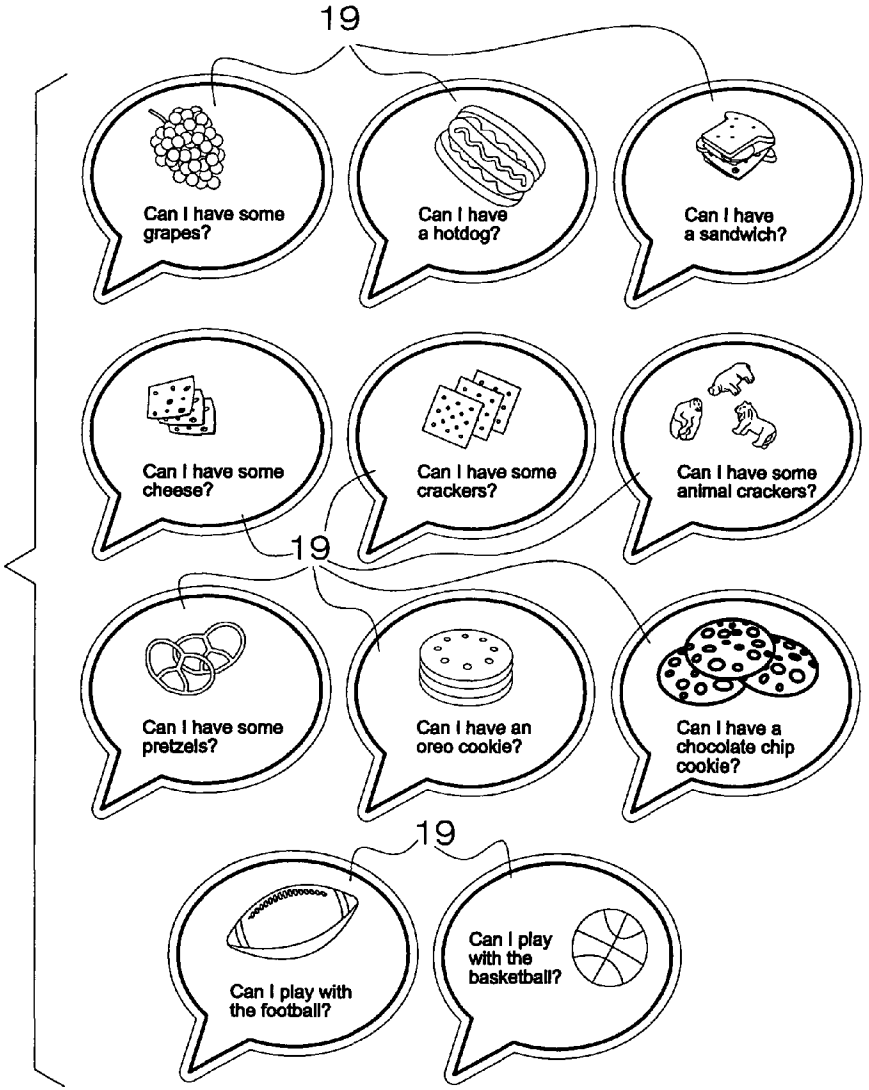
FIG. 6 illustrates front views of eleven examples of one possible version of a Pre-Printed Question Card.
Figure 7:
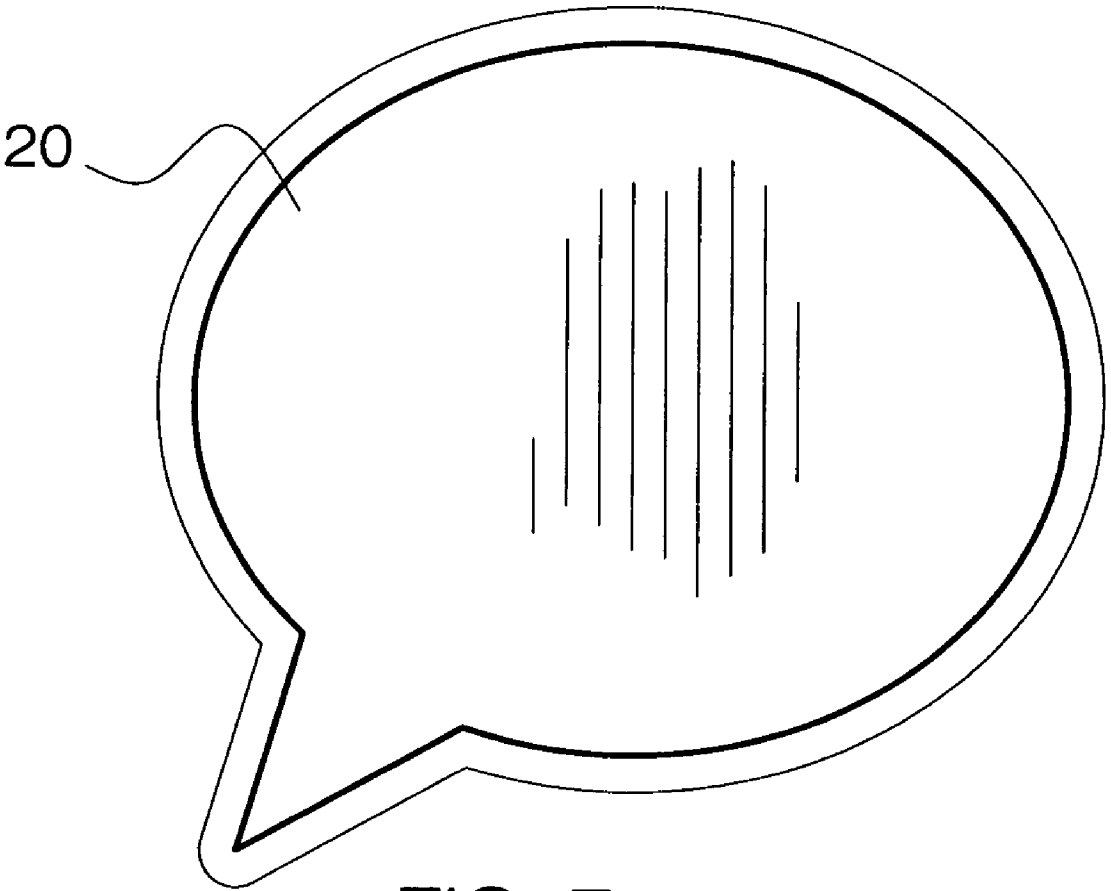
FIG. 7 illustrates a front view of one possible version of a Blank Question Card.

One possible embodiment of the invention includes the following components: 1) a plurality of Question Cards as in FIG. 6 and FIG. 7, which may include Pre-Determined Question Cards 19, each of which bears a question presented in written or graphic form, or both, requesting permission to have a particular item or to engage in a particular activity, some of these items or activities being highly preferred by the player, and others being neutral ones in which the player may have no particular interest one way or another, as well as Blank Question Cards 20 which allow a trainer to personalize questions for a player by manually entering his own questions in written or graphic form, or both; 2) a plurality of Answer Cards 11, 12, 13, 14, 15, 16, 17, 18, each of which bears one answer in a set of pre-determined possible answers to the Question Cards 19, 20, answers being presented in written or graphic form, or both; 3) a Game Board 0 with a plurality of spots 3, 4, 5, 6, 7, 8, 9 for the sequential placement of Answer Cards 11, 12, 13, 14, 15, 16, 17, 18; and 4) one or more Data Collection Sheets 21, 22. On possible version of a Game Board 0, depicted in FIG. 1, has seven consecutively enumerated spots 3, 4, 5, 6, 7, 8, 9 for the placement of Answer Cards 11, 12, 13, 14, 15, 16, 17, 18. Each spot, which corresponds to a trial of a game session, is identified by a unique Arabic numeral between one and seven, as well as a stylized picture of one or more hands 10-A signing by extended digits for each spot from the first spot through the sixth (penultimate) spot the unique numeral for that spot, and for the seventh (final) spot a stylized picture of a trophy 10-B suggesting a game win and reward upon reaching the seventh (final) spot.

Figure 3:
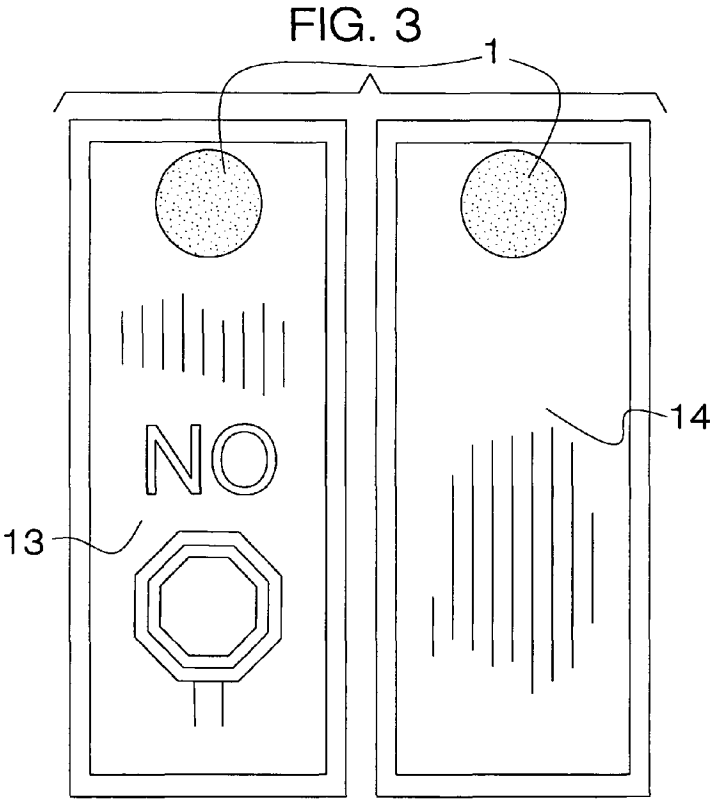
FIG. 3 illustrates front and rear views of one possible version of a "No" Answer Card.
Figure 2:
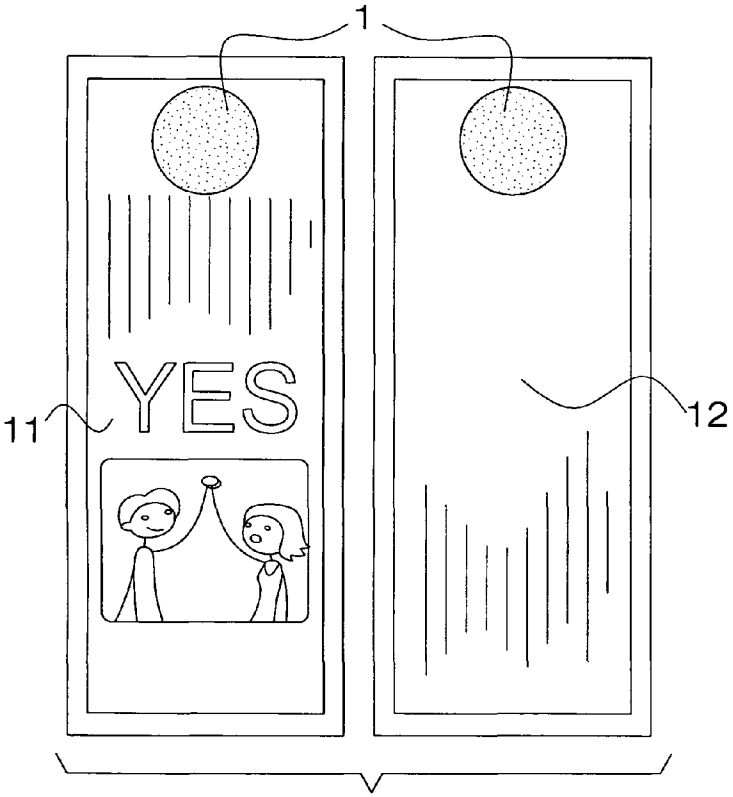
FIG. 2 illustrates front and rear views of one possible version of a "Yes" Answer Card.
Figure 5:
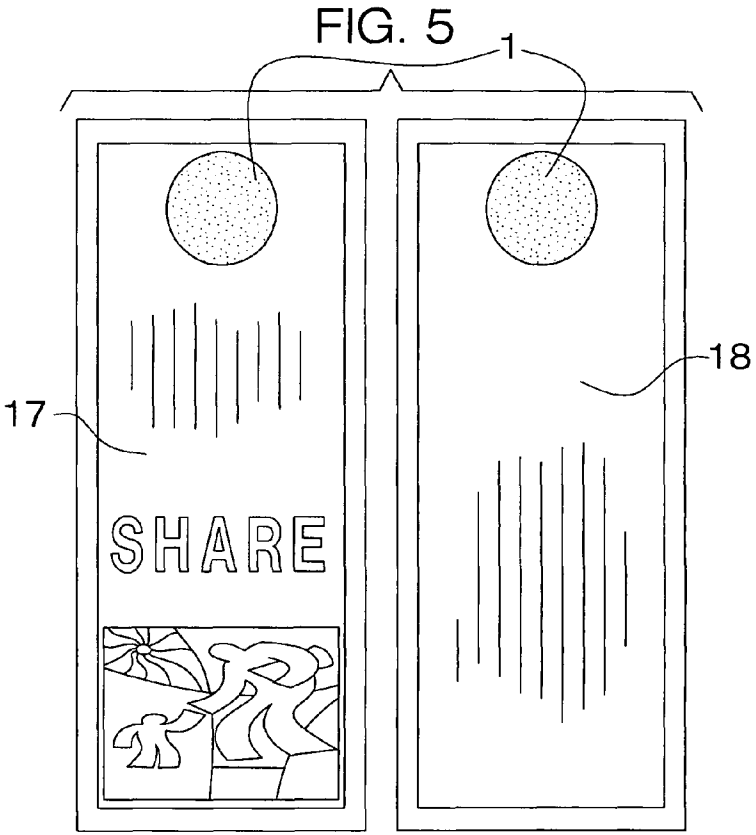
FIG. 5 illustrates front and rear views of one possible version of a "Share" Answer Card.
Figure 4:
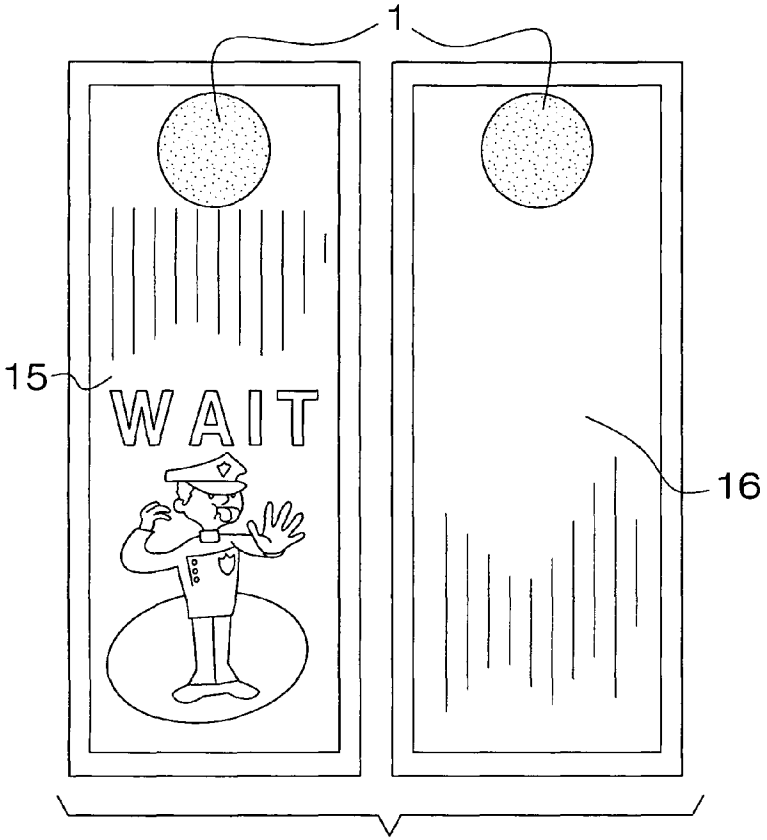
FIG. 4 illustrates front and rear views of one possible version of a "Wait" Answer Card.

In one particular embodiment of the invention, there are 48 Pre-Determined Question Cards 19, each bearing a picture of an item or activity that a player may request; 6 Blank Question Cards 20; and 22 Answer Cards 11, 12, 13, 14, 15, 16, 17, 18, consisting of a mixture of: 1) "Yes" Cards, as depicted in FIG. 2, which on the front side 11 bear the word 'Yes' and indicate that the player immediately may have the item or engage in the activity requested by the player, and further bear a stylized picture of a boy and a girl "high-fiving", and which on the rear side 12 are blank; 2) "No" Cards, as depicted in FIG. 3, which on the front side 13 bear the word 'No' and indicate that the player may not access the item or engage in the activity requested by the player, and further bear a stylized picture of an octagonal stop sign shape, and which on the rear side 14 are blank; 3) "Wait" Cards, as depicted in FIG. 4, which bear on the front side 15 the word 'Wait' and indicate that the player may have access to the item or engage in the activity requested by the player after a pre-determined amount of time, and further bear a stylized picture of a policeman holding up one hand in a 'hold your position' signal, and which on the rear side 16 are blank; and 4) "Share" Cards, as depicted in FIG. 5, which on the front side 17 bear the word 'Share' and indicate that the player may have access to the item or engage in the activity requested by the player, but must share possession of that item or participation in that activity with someone else, and further bear a stylized picture of a large person reaching down as if giving something to a small person, and which on the rear side 18 are blank.

The Game Board 0, Question Cards 19, 20 and Answer Cards 11, 12, 13, 14, 15, 16, 17, 18 may be made of paper, plastic, wood, metal, or other suitable material, and may be laminated to improve their durability. Velcro® dot fasteners 1, 2, having hard-sided 1 and soft-sided 2 components, or other removable fasteners may be used to removably attach the Answer Cards 11, 12, 13, 14, 15, 16, 17, 18 to the Game Board 0 with either the front sides 11, 13, 15, 17 or rear sides 12, 14, 16, 18 displayed. In one particular embodiment, a soft-sided 2 component of a Velcro® dot removable fastener is fixed at the top of each spot 3, 4, 5, 6, 7, 8, 9 on the Game Board 0 to allow either side of an Answer Card 11, 12, 13, 14, 15, 16, 17, 18 to be removably affixed to the Game Board 0 at that spot by means of a companion hard-sided component of a Velcro® dot removable fastener 1 affixed to either side of the Answer Card 11, 12, 13, 14, 15, 16, 17, 18. This, in turn, allows the display at any given spot 3, 4, 5, 6, 7, 8, 9 of the rear side 12, 14, 16, 18 of an Answer Card 11, 12, 13, 14, 15, 16, 17, 18, which rear side may be blank, or the display at that spot of the front 11, 13, 15, 17 side of the Answer Card 11, 12, 13, 14, 15, 16, 17, 18, which may reflect an answer such as "Yes", "No", "Wait", or "Share" in words, pictures or other symbols, or both. The spots on the Game Board 0 may have, as depicted in FIG. 1, a columnar design to accommodate Answer Cards 11, 12, 13, 14, 15, 16, 17, 18 with a columnar design. Question Cards 19, 20 each may be designed in a stylized cartoon-style talk balloon shape to convey the idea of a question being asked orally.

In preparation for playing a game session, a trainer will identify Question Cards 19, 20 to be used with each player by selecting for that player at least five highly preferred items and five neutral items that will be presented in rotation during trials (turns) of a game session. A trainer will further identify Answer Cards 11, 12, 13, 14, 15, 16, 17, 18 to use with each player learning core replacement behaviors.

Figure 8:
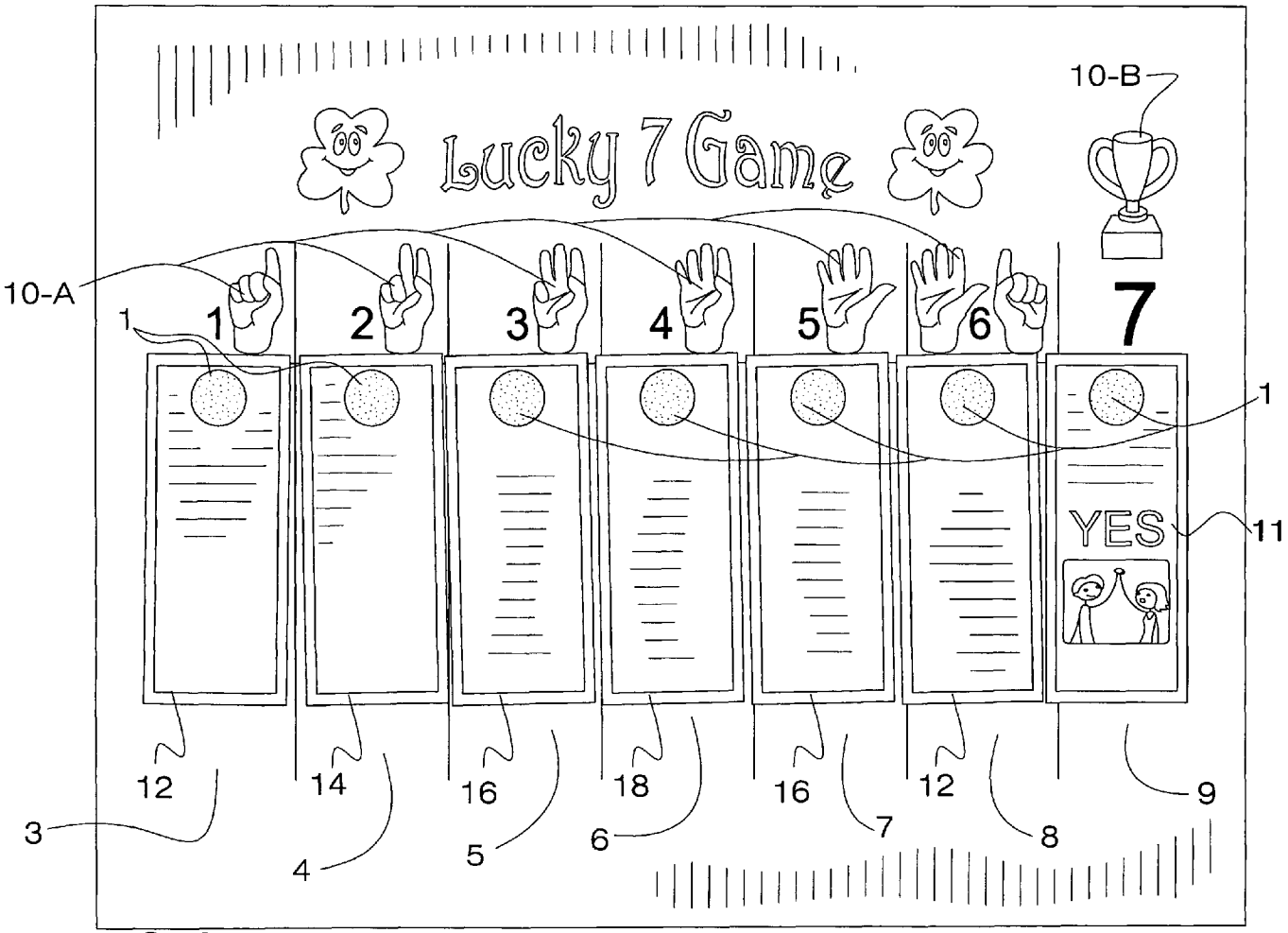
FIG. 8 presents an overhead perspective of a Game Board with a "Yes" Answer Card placed with its front side displayed in the final spot and the remaining Answer Cards placed with blank rear sides displayed in the first through penultimate spots.
Figure 10:
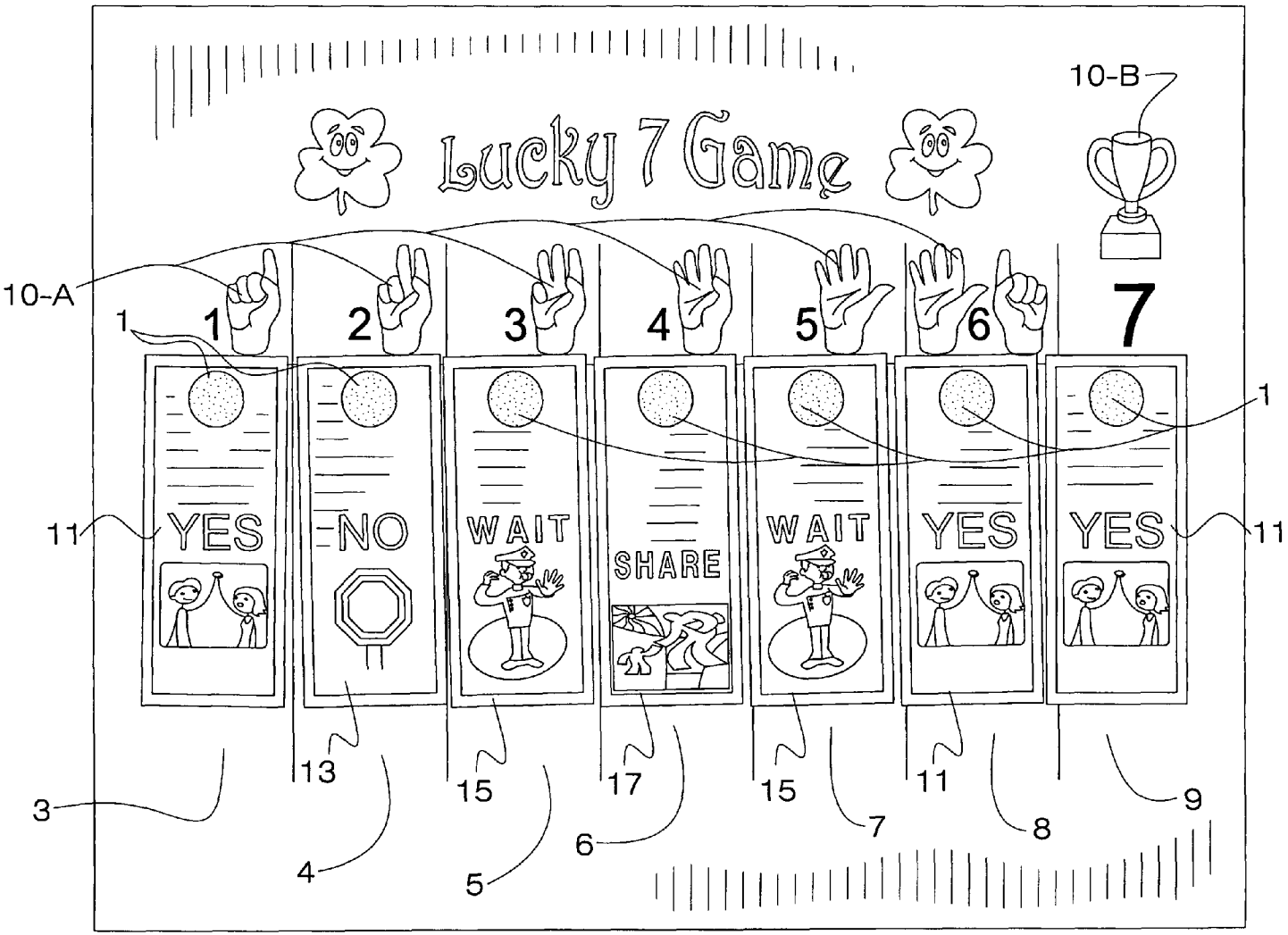
FIG. 10 presents an overhead perspective of a Game Board showing an example of how various Answer Cards may be sequentially placed and displayed along the sequential spots on the Game Board after being turned over during the trials of a game session.

During the first several sessions, a trainer could select a minimum of three "Yes" Cards 11, 12, two "No" Cards 13, 14, one "Wait" Card 15, 16 and one "Share" Card 17, 18. If Sharing is a primary targeted replacement behavior, for example, a trainer could include several "Share" Cards 17, 18 in a game session in order to provide greater opportunities for the player learning core replacement behaviors to practice Sharing as a core replacement behavior. The trainer will removably affix to the Game Board 0 the Answer Cards 11, 12, 13, 14, 15, 16, 17, 18 selected so that some or all of the Answer Cards are face down—i.e., blank rear sides 12, 14, 16, 18 displayed—at the beginning of the game, as depicted in FIG. 8. During play, when a player turns over an Answer Card to check the answer, the Answer Card can then be removably affixed to the Game Board 0 once again, this time face up—i.e., front sides 11, 13, 15, 17 displayed. FIG. 10 illustrates how the Game Board 0 might look at the end of a game session with the front sides 11, 13, 15, 17 of the Answer Cards in all spots 3, 4, 5, 6, 7, 8, 9 displayed after all of them have been turned over during play.

After selecting the Question Cards 19, 20 and Answer Cards 11, 12, 13, 14, 15, 16, 17, 18 for each player, a trainer may pre-arrange these cards to ensure the highest probability of success for the player. Selected Question Cards 19, 20 may be ordered in a stack along side the Game Board 0 so that they are in the same order as the Answer Cards 11, 12, 13, 14, 15, 16, 17, 18 the trainer has selected, which are each removably affixed to the Game Board 0 in an enumerated spot selected by the trainer, blank rear side displayed, as depicted in FIG. 6, spots 3, 4, 5, 6, 7, 8.

Placement of the Answer Cards 11, 12, 13, 14, 15, 16, 17, 18 may be made according to the plan of the trainer for demand fading. For example, a trainer could start play with Question Cards 19, 20 and Answer Cards 11, 12, 13, 14, 15, 16, 17, 18 matched by the trainer to create primarily easy tasks for the player to accomplish, and over subsequent game sessions, the trainer could fade in gradually an increasing number of difficult tasks (e.g., accepting "No" to a highly desired request). The trainer further could intersperse easy and difficult tasks every time the game is played, so that the player never is presented with several difficult tasks to perform in consecutive order, but rather, always has an easier task following one or two (or at a later stage, possibly three or more) difficult tasks.

A trainer may ensure that Question Cards 19, 20 matched with "No", "Wait" and "Share" Answer Cards 13, 14, 15, 16, 17, 18 are initially neutral stimuli, or items or activities less-preferred by a player, so that they will not trigger precursor or problem behaviors by being denied, shared, or delayed. Gradually, in subsequent game sessions, the trainer may elect to fade in gradually more "No," "Wait," and "Share" Answer Cards 13, 14, 15, 16, 17, 18 that correspond increasingly to more desirable items and activities. A trainer may continue to intersperse at least two or three easy tasks each time the game session is played.

Figure 9:
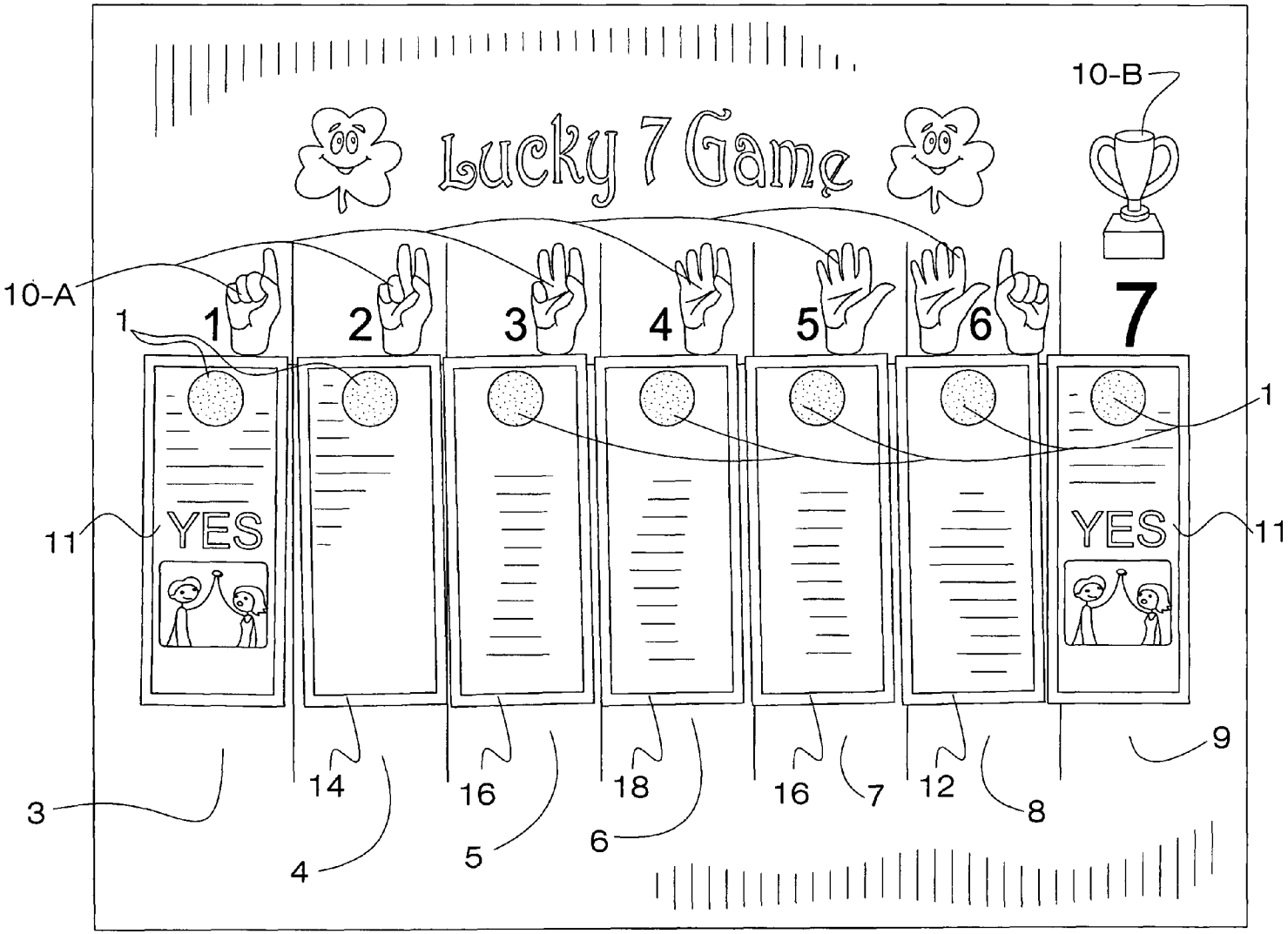
FIG. 9 presents an overhead perspective of a Game Board with "Yes" Answer Cards placed with their front sides displayed in the first spot and in the final spot, and the remaining Answer Cards placed with blank rear sides displayed in the second through penultimate spots.

At the beginning of play, as reflected in FIG. 8 and FIG. 9, the trainer may removably affix a "Yes" Answer Card 11, 12, optionally with the front side 11 displayed as in FIG. 9, in the first spot 3 on the Game Board 0. In this way, from the first trial of that game session, the player learning core replacement behaviors experiences positive reinforcement immediately (which may help to generate behavioral momentum).

The first time a player is exposed to the game, a trainer may begin by introducing the game to the player. Such an introduction may include going over the key phrases (rules) the player will be learning throughout each game session, such as "Ask the question," "Sometimes you have to wait," "Sometimes you need to share," and "Sometimes the answer is 'No'."

A trainer may start the game by identifying a promised reinforcer (MO) for a player that is an item the player can consume or an activity the player can perform. A trainer also may allow the player to choose from a menu of potential promised reinforcers. Question Cards 19, 20 represent promised reinforcers.

A trainer will communicate to a player that the identified or player-selected item or activity will be available to the player when the player reaches the last spot 9 on the Game Board 0, i.e., when the last trial has been completed. A "Yes" Answer Card 11, 12 should always be placed at the last spot 9 on the Game Board 0. Initially, as reflected in FIG. 8, it may be helpful for the "Yes" Answer Card 11, 12 in the last spot 9 to be removably affixed with the front side 11 of the card displayed so that the player can see the "Yes" answer in that spot throughout the game. This can help keep a player motivated.

A player begins playing by picking a Question Card 19, 20 from the top of the stack and asking for the item or activity revealed by the Question Card 19, 20 using a form of communication appropriate to that player (e.g., speech, signing, etc.). The communication form the player typically uses should be used for the game session. If a player cannot read a Question Card 19, 20 independently, then the trainer may read the Question Card 19, 20 to the player and get the player to repeat the mand (question) in whatever communication form the player uses. If the player has no known form of communication, the use by the trainer of real objects—e.g., candy, a football, etc.—to communicate mands in lieu of Question Cards 11, 12 may be considered.

After a player has repeated the first mand set forth in the first Question Card selected from the stack, the player will then turn over the Answer Card on the first spot 3 on the Game Board 0 to see the answer, e.g., "Yes", "No", "Wait", or "Share". The trainer will respond to the request of the player as indicated on the Answer Card. If the player accepts the answer, the trainer may then provide immediately verbal praise and positive attention to the player. When the answer is "Wait", a timer may be set for a predetermined period to signal the player when the waiting period is over and that they may have access to the item or activity.

If a player does not accept the answer, instead displaying problem behavior, the trainer will say "stop," and attempt to redirect the player to the desired response (if the Answer Card was a "Share" card 17, 18), or redirect the player to draw the next Question Card (if the Answer Card was a "No" Card 13, 14 or a "Wait" Card 15, 16). If a player does not cooperate, a trainer may stop a session and respond to problem behaviors as outlined in any individual Behavior Plan for the player, minimizing reinforcement for problem behaviors. Lack of cooperation by a player should signal the trainer to consider selecting a more potent promised reinforcer, or the need to redesign the instructional sequence for the Question Cards 19, 20 and Answer Cards 11, 12, 13, 14, 15, 16, 17, 18.

Play continues as above in sequence from the first spot 3 to the last spot 9 on the Game Board 0. When the last spot 9 is reached, the player may receive behavior-specific praise and the promised reinforcer that was identified by the trainer or selected by the player at the start of the game session.

To ensure generalization and transfer of core replacement behaviors to the natural environment, direct care providers should observe the player while the game is being played with the trainer in order to become familiar with the phrases used to cue core replacement behaviors during a game session. These phrases may include, but are not limited to, the following: 1) "Ask the question"; 2) "Sometimes you have to wait"; 3) "Sometimes you need to share"; and 4) "Sometimes the answer is 'No'." Direct care providers should regularly use the same cues in the natural environment. Because the core replacement behaviors, and the corresponding cues for performing those behaviors, have been correlated with reinforcement during game sessions, the behaviors will transfer to the natural environment when cued correctly.

The method disclosed herein may be varied in a number of ways as necessary or desirable meet the particular needs and circumstances of individual players. With some players, for example, as suggested above, it could be beneficial during play to use real items in place of Question Cards 19, 20 representing those items. In that scenario, for instance, the trainer might hold up an item and prompt the learner to "ask the question." If the corresponding answer is "Yes," and the item is a ball, the player would be allowed to play with the ball for a minute or two. If this variation is used, a timer may be helpful in order to cue the player as to when it is time to move on to the next trial.

Another variation of the method utilizes two or more players in a given game session. For players who need training in improving their interactions with another individual, for example, such as a sibling or friend, the player in need of such training may play with that other individual, with one or more trainers on hand to monitor and coach the play. In this case, for instance, one player could become an "asker" and the other become a "responder." For each trial, the "responder" would hand a Question Card 19, 20 to the "asker," or hold up an object (in lieu of a Question Card) before the "asker." The "asker" would then request the item and wait for the "responder" to turn over the Answer Card 11, 12, 13, 14, 15, 16, 17, 18 for that trial and respond accordingly. A player to be trained can be assigned to play whatever role, "asker" or "responder", that a trainer may deem most appropriate. If both roles are important, two sessions of the game can be played, with each player having a turn in each role.

Group game sessions are also possible. The game may be played with a group of up to six players. In this case, a trainer would follow the single player directions, except to rotate through the group task by task. A trainer would ensure that each player is provided with the promised reinforcer assigned to or selected by that player upon successful completion of a game session by that player.

Data as to a player's performance and progress in carrying out core replacement behaviors may be collected and recorded both by trainers with respect to game sessions and by direct care providers in the natural environment, i.e., under ordinary day-to-day living circumstances. In one implementation of data collection with respect to game sessions, a trainer might utilize a simple five-column Game Session Data Collection Sheet 21, such as that depicted in FIG. 11. The trainer may identify and record each game session and the date on which the session was conducted in a Game Session Data Field 22, such as that found in the first column of the Game Session Data Collection Sheet 21 in FIG. 11. Items or activities indicated on Question Cards 19, 20 presented in a game session, or objects displayed in lieu of Question Cards 19, 20, could be written next to a corresponding task number in a Task Data Field 23, such as that found in the second column of the Game Session Data Collection Sheet 21 in FIG. 11. An "Ask?" Data Field 24, such as that found in the third column of the Game Session Data Collection Sheet 21 in FIG. 11, could be provided to allow a trainer to indicate whether a player asked a question correctly, required a prompt, or responded incorrectly (i.e., did not comply). Additionally, an "Answer" Data Field 25, such as that provided in the fourth column of the Game Session Data Collection Sheet 21 in FIG. 11, could be provided to allow a trainer to indicate which task answer (e.g., "Yes", "No", "Wait" or "Share") would correspond properly to a particular task question, as well as a player's response when given that answer (e.g., correct, prompted or incorrect).

A "Comments" Data Field 26, such as that found in the fifth and last column of the Game Session Data Collection Sheet 21 in FIG. 11, could be employed to provide an area to note other significant observations during a task. In accordance with a player's Behavior Plan (i.e., a recorded plan for addressing an individual's behavioral challenges), challenging behaviors exhibited by a player, as well as a trainer's response to the exhibition of such challenging behaviors, may also be recorded in the comments section. Game session data recorded by a trainer may be used to plan for future game sessions in accordance with the demand fading guidelines described previously.

To record the progress of an individual player in transferring core replacement behaviors to the natural environment, a Natural Environment Data Collection Sheet 27 such as that depicted in FIG. 12 could allow a direct care provider, for any given date in a Date Data Field 28, to record in a Success Data Field 29 the number of times that individual succeeded in carrying out a core replacement behavior of interest, in a Prompt Data Field 30 the number of times the individual succeeded in doing so after prompting by the direct care provider, and in a No Success-No Compliance Data Field 31 the number of times the individual did not succeed in doing so or refused to comply with the direct care provider. For instance, if manding were a core replacement behavior of interest for an individual player, for any given date recorded on a data collection sheet, then each time an opportunity arose for the individual to ask for an item, activity, or attention, the direct care provider could mark a "+" in a section for recording correct responses by the individual each time the individual responded correctly without prompting, a "P" in a section for recording correct responses by the individual each time the individual responded correctly with prompting, and a "—" in a section for recording incorrect responses by the individual each time the individual responded incorrectly or did not comply, or both.

What is claimed is:

1. A method for teaching and practicing core replacement behaviors to individuals with behavioral challenges by manipulating motivating operations through discrete trial training, whereby there is established a discrete teaching session in which the learner practices asking for what he or she wants as well as practicing accepting the possible variations of answers, comprising the steps of:

providing a game apparatus comprising a plurality of Question Cards by which a player may request permission to have particular items or to engage in particular activities, each such Question Card referencing a single such item or activity, some of these items or activities being highly preferred by the player, and others being neutral ones in which the player may have no particular interest one way or another, and at least one of said Question Cards serving to represent a promised reinforcer that a player may receive upon successful completion of a game session, some said Questions Cards being Pre-Determined Question Cards and others being Blank Question Cards;

a plurality of Answer Cards, each of which bears one answer in a set of pre-determined possible answers in response to any given Question Card, said answer being reflected in works, pictures or other symbols, or bother words and pictures or symbols, comprised of "Yes," "No," "Wait," and "Share" cards;

a Game Board with a plurality of spots for the sequential placement of Answer Cards; and one or more Data Collection Sheets;

selecting a plurality of Question cards for a player, some of said Question Cards referencing items or activities, or both, highly preferred by the player and other of said Question Cards referencing items or activities, or both, highly preferred by the player and other of said Question Cards referencing items or activities, or both, which the player dislikes or in which the player may have no particular interest;

selecting a plurality of Answer Cards for a player;

pre-arranging the selected Question Cards and Answer Cards for a player so that a given Question Card will be matched with a particular Answer Card;

identifying, through selection by a trainer or through selection by a player, a Question Card representing a highly preferred item or activity desired y the player to serve as a promised reinforcer;

communicating to a player that the promised reinforcer will be made available to the player when the player reachers the last spot on the Game Board;

causing, for each trial of a plurality of trials comprising a game session, a player to select a Question Card and to request the item or activity revealed by the Question Card using a form of communication appropriate to that player;

revealing the answer on the Answer Card to the request for the item or activity revealed by the Question Card for that trial;

responding to the request of the player in accordance with the answer revealed by the Answer Card;

providing verbal praise and positive attention to the player if the player accepts the response to the request of the player;

saying "Stop" and attempting to redirect the player to the desired response where the Answer Card is a "Share Card, or attempting to redirect the player to the next Question Card where the Answer Card is a "No" or "Wait" Card, if the player does not accept the response to the request of the player;

stopping the game session and responding to, but minimizing reinforcement for, problem behaviors that may be exhibited by the player if the player does not cooperate;

continuing play from trial to trial until the last spot on the Game Board is reached;

providing the player with behavior-specific praise or the promised reinforcer, or both;

recording data regarding the performance of the player during the game session; and using the recorded data to plan for future game sessions wherein the game apparatus further comprises one or more of:

A. Question cards and Answer cards made of paper;

B. Laminated Game Board, Question Cards and Answer Cards;

C. Removable fasteners used to removable affix the Answer Cards to the Game Board with either the front sides or rear sides of the Answer Cards displayed;

D. A soft-sided component of a Velcro™ dot removable fastener faxed at the top of each numbered spot on the Game Board to allow an Answer Card to be removable affixed to the Game Board at that spot my means of a companion hard-sided component of a Velcro™ dot removable fastener, a hard-sided component being affixed to both the front and rear sides of the Answer Card so that the Answer Card may be removably affixed to a spot on the Game Board to display either side of the Answer Card;

E. Question Cards which are either pre-determined or blank;

F. 48 Predetermined Question Cards and 6 Blank Question Cards;

G. 22 Answer Cards, consisting of a mixture of "Yes" Cards reflecting an answer of "Yes," "No" Cards reflecting an answer of "No", "Wait Cards" reflecting an answer of "Wait," and "Share Cards" reflecting an answer of "Share;"

H. The rear side of each Answer Card is blank, and the front side of each Answer Card reflects the answer for that card in words and pictures;

I. Answer Cards of a columnar design, spots on the Game Board having a columnar design to accommodate said Answer Cards, and Question Cards designed in a stylized cartoon-style talk balloon shape to convey the idea of a question being asked orally;

J. A Game Board with seven consecutively enumerated spots for the placement of Answer Cards, each spot being identified by a unique Arabic numeral between one and seven, as well as the first spot through the sixth (penultimate) spot by a stylized picture of one or more hands signing by extended digits for each spot the unique numeral for that spot, and the seventh (final) spot by a stylized picture of a trophy;

K. Data Collection Sheets comprising at lease one Data Collection Sheet for a trainer record data as to a player's performance and progress in carrying out core replacement behaviors during game sessions and at least one Data Collection Sheet for a direct care provider to record data as to a player's performance and progress in carrying out core replacement behaviors in the natural environment.

2. The method of claim 1, further comprising the step of interspersing easy and difficult tasks for a player through pre-arrangement of Question Cards and Answer Cards prior to a game session.

3. The method of claim 1, further comprising the step of creating demand fading through pre-arrangement of Question Cards and Answer Cards prior to a game session.

4. The method of claim 1, further comprising the step of programming for transfer of behaviors to the natural environment through the intermittent participation of one or more direct care providers in game sessions with a trainer and a player to enable said one or more direct care providers to learn key phrases, to become paired with a promised reinforcer, and to use one or more of said key phrases as cues and prompts to signal a player to perform one or more core replacement behaviors in natural situations.

5. The method of claim 1, in which one or more real items are used in place of Question Cards representing those items.

6. The method of claim 1, in which one or more trainers assign to one player the role of "asker" and to the other player the role of "responder", and monitor and coach play between the two players.

7. The method of claim 1, further comprising the steps of rotating from player to player in a group of up to six players on a task by task basis and ensuring that each player is provided with a promised reinforcer assigned to or selected by that player upon successful completion of the game by that player.

8. The method of claim 1, further comprising the step of recording the progress of a player in transferring core replacement behaviors to the natural environment.

* * * * *